US009388653B2

(12) United States Patent
Hufthammer

(10) Patent No.: US 9,388,653 B2
(45) Date of Patent: Jul. 12, 2016

(54) METHOD AND APPARATUS FOR SUBSEA WELL PLUG AND ABANDONMENT OPERATIONS

(71) Applicant: IKM Cleandrill AS, Straume (NO)

(72) Inventor: Harald Hufthammer, Straume (NO)

(73) Assignee: IKM CLEANDRILL AS (NO)

( * ) Notice: Subject to any disclaimer, the term of this patent is extended or adjusted under 35 U.S.C. 154(b) by 0 days.

(21) Appl. No.: 14/404,343

(22) PCT Filed: Mar. 27, 2014

(86) PCT No.: PCT/GB2014/050986

§ 371 (c)(1),
(2) Date: Nov. 26, 2014

(87) PCT Pub. No.: WO2014/155126

PCT Pub. Date: Oct. 2, 2014

(65) Prior Publication Data

US 2016/0017683 A1 Jan. 21, 2016

(30) Foreign Application Priority Data

Mar. 27, 2013 (NO) ..... 20130438

(51) Int. Cl.
*E21B 21/01* (2006.01)
*E21B 33/035* (2006.01)
(Continued)

(52) U.S. Cl.
CPC ..... *E21B 33/0355* (2013.01); *E21B 21/001* (2013.01); *E21B 21/01* (2013.01); *E21B 21/08* (2013.01); *E21B 34/04* (2013.01); *E21B 47/04* (2013.01)

(58) Field of Classification Search
CPC ..... E21B 21/001; E21B 21/01; E21B 21/08; E21B 33/0355; E21B 34/04; E21B 41/0007; E21B 47/04
USPC ..... 166/336
See application file for complete search history.

(56) References Cited

U.S. PATENT DOCUMENTS 3,198,250 A 8/1965 Hoch et al.
4,149,603 A * 4/1979 Arnold ..... E21B 7/128 166/368

(Continued)

FOREIGN PATENT DOCUMENTS

GB 2407835 5/2005
NO WO 2012156742 A2 * 11/2012 ..... E21B 33/035

(Continued)

OTHER PUBLICATIONS

International Search Report and Written Opinion for PCT/GB2014-050986 mailed Oct. 27, 2015.

(Continued)

*Primary Examiner* — Matthew R Buck
(74) *Attorney, Agent, or Firm* — Workman Nydegger

(57) ABSTRACT

The invention provides a method and apparatus for performing a plug and abandonment operation on a subsea well. A wellhead interface module is located on a wellhead, which accommodates a volume of wellbore fluid in fluid communication with the wellbore. A system control module receives a signal from a sensor in the chamber and is configured to derive volume data relating to a change in volume of wellbore fluid in the chamber and compares the derived volume data with a volume change expected due to the removal of tubing from the wellbore. In embodiments of the invention, this enables a change in wellbore conditions to be characterized, for example a fluid influx or a fluid loss, from the volume data. The method may comprise providing wellbore fluid to the apparatus to replace fluid which enters the wellbore to occupy the volume vacated by the tubing, and/or removing or adding fluid in fluid influx/loss situations respectively.

25 Claims, 9 Drawing Sheets

(51) Int. Cl.

| | |
|---|---|
| ***E21B 21/00*** | (2006.01) |
| ***E21B 21/08*** | (2006.01) |
| ***E21B 34/04*** | (2006.01) |
| ***E21B 47/04*** | (2012.01) |

(56) References Cited

U.S. PATENT DOCUMENTS

| | | | | |
|---|---|---|---|---|
| 6,877,565 | B2 * | 4/2005 | Edvardsen | E21B 21/001 166/352 |
| 7,185,705 | B2 * | 3/2007 | Fontana | E21B 21/015 166/356 |
| 8,353,351 | B2 * | 1/2013 | Carpenter | E21B 21/08 166/311 |
| 2002/0060076 | A1 | 5/2002 | Harrell | |
| 2008/0190663 | A1 | 8/2008 | Stave | |
| 2011/0056696 | A1 | 3/2011 | Bamford | |
| 2012/0227978 | A1 * | 9/2012 | Fossli | E21B 21/001 166/363 |
| 2014/0305657 | A1 * | 10/2014 | Eikemo | E21B 33/035 166/351 |

FOREIGN PATENT DOCUMENTS

| | | |
|---|---|---|
| WO | WO03023181 | 3/2003 |
| WO | 2006118920 | 11/2006 |
| WO | 2011089443 | 7/2011 |
| WO | WO2012015315 | 2/2012 |
| WO | WO2012140446 | 10/2012 |
| WO | WO2012156742 | 11/2012 |
| WO | WO2014155126 | 10/2014 |

OTHER PUBLICATIONS

International Search Report and Written Opinion for PCT/GB2014/050986.

* cited by examiner

METHOD AND APPARATUS FOR SUBSEA WELL PLUG AND ABANDONMENT OPERATIONS

CROSS-REFERENCE TO RELATED APPLICATIONS

This application claims priority to and the benefit of PCT Application No. PCT/GB2014/050986, filed Mar. 27, 2014, entitled "METHOD AND APPARATUS FOR SUBSEA WELL PLUG ABANDONMENT OPERATIONS", which claims the benefit of and priority to Norwegian Patent Application No. 20130438, filed Mar. 27, 2013, each of which is incorporated herein in its entirety.

The present invention relates to a method and apparatus for subsea well plug and abandonment operations, and in particular to a method and apparatus for controlling a fluid in a subsea wellbore system during a plug and abandonment procedure. Aspects and embodiments of the invention relate to a vessel-based riser-less method and apparatus for controlling a volume of fluid during a plugging and abandonment operation on a subsea hydrocarbon well.

BACKGROUND TO THE INVENTION

The drilling and construction of wells, for example for the hydrocarbon exploration and production industry, includes many different operations which involve the pumping of fluids from surface through the wellbore and back to surface. A drilling operation typically involves the rotation of a drill bit on the end of a drill string (or drill pipe), which extends from a drilling platform to a drill bit. Drilling fluid (referred to as drilling mud) is pumped from one or more pits on a drilling rig down through the drill string to the drill bit to fulfil a number of different functions, including providing hydrostatic pressure to control the entry of fluids from the formation into the wellbore, lubricating the drill bit, keeping the drill bit cool during drilling, and carrying particulate materials such as drill cuttings upwards and out of the well away from the drill bit. Drilling fluid and cuttings emanating from the wellbore are carried up the annular space between the wall of the bore being drilled and the drill pipe to the mudline. In conventional subsea drilling, a riser is installed above a blow-out preventer (BOP) stack on top of the wellhead, and extends to the surface. Drilling fluid and cuttings are returned to the drilling rig for processing, re-use, storage, removal and/or treatment through the annulus between the drill pipe and the riser.

Typically the drilling fluid system is a closed-loop system, which has a known well volume through which the drilling fluid is circulated, and one or more drilling fluid or "mud" pits on the drilling rig. The rig crew monitors the level of drilling fluid in the pit to detect unwanted influx of reservoir fluids (including gases) into the wellbore, referred to as a "kick". The rig crew responds to kicks by adding one or more barriers to control the influx and circulate the additional fluid out of the wellbore and prevent uncontrolled flow of fluids into the well. Parameters monitored include "pit gain", which is the difference between the volume of fluid pumped into the well and the volume of fluid pumped out of the well. In a closed-loop system for a stable well, the two values should be equal, whereas a positive pit gain will indicate an influx of reservoir fluid and a pit loss will indicate a loss of drilling fluid into the formation.

For a single pit drilling system, pit gain can be determined by monitoring the level of drilling fluid in the pit. Active pit systems are computer-controlled systems which enable several pits to be aggregated into one "active pit volume", which can be treated as a single pit for monitoring pit gain.

When a production well reaches the end of its economic or technical viability, it may be necessary to temporarily or permanently plug and abandon (P&A) the well to establish a permanent barrier against the flow or migration of hydrocarbons to the surface. Plug and abandonment methodologies are varied, but conventionally use a drilling rig (such as a jack-up rig installation) to install a blowout preventer (BOP) stack and marine riser on the well. The production tubing is cut and pulled to surface to enable one or more cross-sectional barriers or plugs to be installed in the wellbore. During the Pulling Out of Hole (POOH) of the tubing, the drilling fluid circulation system of the rig is used to provide drilling fluid from the pit, via the marine riser, to the wellbore to compensate for the loss of volume as the tubing is removed from the well. During POOH of the production tubing, pit gain can be monitored at surface to determine whether there is an influx or outflow of fluid which is indicative of a problem with the seal or seals provided by the plugs. The BOP stack provides full control of wellbore fluids and enables any unwanted flow of reservoir fluids into the annulus to be mitigated against.

Methods which rely on the use of drilling rigs are expensive and time-consuming to mobilise. These disadvantages, coupled with problems associated with the lack of availability of drilling rigs, have led to a number of new proposals for rig-less plug and abandonment operations which utilise vessels rather than drilling rigs. Vessels do not commonly have a marine riser, and so to utilise vessels for plugging and abandonment requires new 'riser-less' techniques to be developed.

It has also been proposed to use coiled tubing systems in plugging and abandonment operations, to mitigate the reliance on drilling rig deployment and to enable the operations to be controlled from a vessel such as a lightweight intervention vessel (LWIV). However, a coiled tubing intervention, in the absence of deployment through a marine riser, does not provide a return annulus for drilling fluids and does not enable volume control as the tubing is removed from the well.

It is known to provide drilling fluid collection, handling and return equipment in subsea drilling operations which do not use conventional marine risers. For example, when drilling the uppermost section of the wellbore, which is referred to as the "tophole" is drilled, there is no riser pipe installed between the seabed and the drilling rig, and as there is no return path for drilling fluids from the wellbore back to the surface, the drilling mud and cuttings are conveyed to surface via a dedicated return line. One such system is described in U.S. Pat. No. 4,149,603 [1], and uses a riserless mud return system including a hose, separate from the drill string, to carry mud to the surface. A pumping means is used to pump mud through the hose back to surface, with the pump operated in dependence on the detected level of mud and cuttings supported within a mud sump. Additional examples of systems which pump drilling fluids to surface via dedicated return lines are disclosed in US 2008/0190663 and the applicant's co-pending international publication numbers WO 2012/140446 and WO 2012/156742.

There is generally a need for a method and apparatus which addresses one or more of the problems associated with conventional plugging and abandonment techniques when used from vessels.

It is amongst the aims and objects of aspects of the invention to provide a method and/or apparatus for controlling the volume of a fluid in a subsea wellbore system which obviates or mitigates one or more drawbacks or disadvantages of the prior art. It is an aim of at least one aspect of the invention to provide a method and apparatus for the plugging and abandonment of subsea hydrocarbon wellbores. A further aim of at least one aspect of the invention is to provide a vessel-based method and apparatus for controlling the volume of fluid during a plugging and abandonment operation on a subsea hydrocarbon well, which may be performed from a LWIV and without relying on a drilling rig and/or marine riser system.

It is another aim and object of an aspect of the invention to provide a method and apparatus for controlling the re-filling of a subsea hydrocarbon well from a dedicated well fluid hose during a plugging and abandonment operation.

Further aims and objects of the invention will become apparent from reading the following description.

SUMMARY OF THE INVENTION

According to a first aspect of the invention, there is provided a method of performing a plug and abandonment operation on a subsea hydrocarbon well, the method comprising: providing an apparatus having a wellhead interface module located on a wellhead, the wellhead interface module comprising a body defining a chamber which accommodates a volume of wellbore fluid in fluid communication with the wellbore, a subsea flow control package, a fluid conduit extending between the subsea flow control package and surface, and a system control module, wherein the subsea flow control package defines a first flow path between wellhead interface module and the fluid conduit via a pump and defines a second flow path between the wellhead interface module and the fluid conduit via a flow control valve;

removing a length of tubing or casing from the wellbore;

controlling, using the subsea flow control package, the flow of a wellbore fluid from the fluid conduit to re-fill the chamber of the wellhead interface module;

enabling wellbore fluid to flow from the chamber into the wellbore;

monitoring at least one parameter of the wellbore fluid in the chamber and outputting a measurement signal to the system control module in dependence on the at least one parameter;

deriving volume data relating to a change in volume of wellbore fluid in the chamber; comparing the derived volume data with a volume change expected due to the removal of tubing or casing from the wellbore.

According to a second aspect of the invention, there is provided a method of performing a plug and abandonment operation on a subsea hydrocarbon well, the method comprising:

providing an apparatus having a wellhead interface module located on a wellhead, the wellhead interface module comprising a body defining a chamber which accommodates a volume of wellbore fluid in fluid communication with the wellbore; and a system control module;

removing a length of tubing or casing from the wellbore;

enabling wellbore fluid to flow from the chamber into the wellbore;

monitoring at least one parameter of the wellbore fluid in the chamber and outputting a measurement signal to the system control module in dependence on the at least one parameter;

deriving volume data relating to a change in volume of wellbore fluid in the chamber;

comparing the derived volume data with a volume change expected due to the removal of tubing or casing from the wellbore.

The method may comprise providing wellbore fluid from a wellbore fluid source to the wellbore system consisting of the apparatus and the wellbore, in response to the derived volume data.

Preferably, the method comprises characterising the change in wellbore conditions according to the group comprising: a steady state; a fluid influx state; a fluid loss state; a tubing run-in state; or a tubing pull-out state. The method may comprise displaying a characterised change to an operator.

The method may comprise removing a second length of tubing or casing from the wellbore and monitoring at least one parameter of the wellbore fluid in the chamber and outputting a measurement signal to the system control module in dependence on the at least one parameter.

The method may comprise providing additional wellbore fluid from a wellbore fluid source to the chamber in response to the derived volume data.

The wellbore fluid source may provide a head of wellbore fluid pressure.

The method may comprise repeating the steps of removing the tubing or casing and providing wellbore fluid from a wellbore fluid source to the chamber in response to the measurement signal.

Preferably the method comprises providing wellbore fluid from a wellbore fluid source to the wellbore system while the tubing or casing is stationary (or between successive steps of removing tubing from the wellbore).

Preferably, the method comprises measuring, using a level sensor of the wellhead interface module, the level of wellbore fluid in the chamber and outputting a measurement signal to the system control module.

The method may comprise cutting a length of tubing or casing, which step may be performed during refill of the chamber.

The method may comprise analysing the measurement signal to identify a condition of the wellbore, which may be classified as one or more of a steady state; a fluid influx state; a fluid loss state; a tubing run-in state; or a tubing pull-out state.

The method may comprise providing wellbore fluid from a wellbore fluid source to the chamber, and may comprise pumping wellbore fluid from the wellbore fluid source. The method may comprise pumping wellbore fluid from the wellbore fluid source using a feed pump.

The method may comprise controlling the flow of wellbore fluid to the chamber using a subsea flow control valve, which may comprise a choke. The flow of wellbore fluid may be directed through the second flow path defined by the subsea flow control package.

The method may comprise pumping wellbore fluid from the chamber to a remote location, which may be at surface.

The method may comprise deploying the apparatus from a vessel. The vessel may comprise a support vessel, and/or may comprise a lightweight intervention vessel (LWIV).

Embodiments of the second aspect of the invention may include one or more features of the first aspect of the invention or its embodiments, or vice versa.

According to a third aspect of the invention, there is provided apparatus for monitoring and/or controlling the volume of a fluid in a subsea wellbore system during a plug and abandonment operation, the apparatus comprising:

a wellhead interface module configured to be disposed on a wellhead, the wellhead interface module comprising a body defining a chamber which accommodates a volume of wellbore fluid in fluid communication with the wellbore;

a subsea flow control package;

a fluid conduit extending between the subsea flow control package and surface; and a system control module;

wherein the subsea flow control package defines a first flow path between wellhead interface module and the fluid conduit via a pump, and defines a second flow path between the wellhead interface module and the fluid conduit via a flow control valve;

wherein the wellhead interface module comprises a sensor for monitoring at least one parameter of the wellbore fluid in the chamber and outputting a measurement signal to the system control module;

wherein the system control module is configured to derive volume data relating to a change in volume of wellbore fluid in the chamber and compare the derived volume data with a volume change expected due to the removal of tubing or casing from the wellbore;

and wherein the subsea flow control package is configured to control the flow of fluid from the fluid conduit to the wellhead interface module.

Embodiments of the third aspect of the invention may include one or more features of the first or second aspects of the invention or their embodiments, or vice versa.

According to a fourth aspect of the invention, there is provided an apparatus for monitoring and/or controlling the volume of a fluid in a subsea wellbore system during a plug and abandonment operation, the apparatus comprising:

a wellhead interface module configured to be disposed on a wellhead, the wellhead interface module comprising a body defining a chamber which accommodates a volume of wellbore fluid in fluid communication with the wellbore;

and a system control module;

wherein the wellhead interface module comprises a sensor for monitoring at least one parameter of the wellbore fluid in the chamber and outputting a measurement signal to the system control module;

wherein the system control module is configured to derive volume data relating to a change in volume of wellbore fluid in the chamber and compare the derived volume data with a volume change expected due to the removal of tubing or casing from the wellbore.

Preferably, the system control module is configured to characterise the change in wellbore conditions according to the group comprising: a steady state; a fluid influx state; a fluid loss state; a tubing run-in state; or a tubing pull-out state. The system control module may be configured to display a characterised change to an operator.

The apparatus preferably comprises at least one flow control package, and at least one fluid conduit connecting the chamber with the at least one flow control package. The apparatus may comprise a subsea flow control package, and may further comprise a surface flow control package. A fluid return line may connect a subsea flow control package with a surface flow control package.

The apparatus preferably comprises at least one fluid conduit connecting the chamber with the at least one flow control package. The at least one flow control package may be configured to control the flow of wellbore fluid into the chamber from a wellbore fluid source. The wellbore fluid source may comprise a tank, and/or may be disposed at surface.

The at least one flow control package may be configured to control the flow of wellbore fluid from the chamber to a remote location. The remote location may be at surface, and a may be a tank.

The at least one flow control package may comprise a pump, and/or may comprise at least one valve. Preferably the at least one flow control package comprises a pump for pumping wellbore fluid to surface. Preferably the subsea flow control package comprises a subsea flow control valve (which comprises a choke mechanism). The subsea flow control valve is preferably configured to choke the flow from a wellbore fluid source to wellhead interface module. The subsea flow control package may comprise a pump, which may be a variable speed pump.

The wellbore fluid may be drilling fluid or "mud".

The wellhead interface module may be open to a subsea environment in use, and may comprise an upper opening. The body may define a throughbore from an upper opening to the wellhead.

The wellhead interface module may comprise a safety valve, and may comprise an annular blowout preventer. Alternatively or in addition, the wellhead interface module may comprise a shear and seal device.

The apparatus may comprise an optical inspection system, which may comprise a camera and may comprise an illumination source. The optical inspection system may be in two-way communication with the system control module.

The subsea flow control package a may be mounted on a seabed skid. The subsea flow control package may define a first flow path for a fluid passing from a wellbore fluid source and the wellhead interface module, and may define a second flow path for a fluid passing from the wellhead interface module to a remote location. The first and/or second flow paths may comprise one or more shut-off valves.

The surface flow control package may comprise a wellbore fluid source, and may comprise a feed pump. The feed pump may be disposed between the wellbore fluid source and the fluid return line. A bypass flow line may be provided for the feed pump.

The wellbore fluid source may comprise a tank, and/or may further comprise a level sensor for measuring a volume of wellbore fluid in the wellbore fluid source and outputting a measurement signal to the system control module.

Preferably the apparatus is configured to be used in a plug and abandonment operation. More preferably, the apparatus is configured to be used in a rig-less plug and abandonment operation, and/or is configured to be deployed from a vessel. The vessel may comprise a support vessel, and/or may comprise a lightweight intervention vessel (LWIV).

The system control module may be implemented in software, and may be configured to run on a computer system and provided on a vessel.

Embodiments of the fourth aspect of the invention may include one or more features of the first to third aspects of the invention or their embodiments, or vice versa.

According to a fifth aspect of the invention, there is provided a system comprising the apparatus according to the second aspect of the invention, a vessel, and the wellbore on which the wellhead interface module is disposed.

Embodiments of the fifth aspect of the invention may include one or more features of the first to fourth aspects of the invention or their embodiments, or vice versa.

According to a sixth aspect of the invention, there is provided a method of performing a plug and abandonment operation on a subsea hydrocarbon well, the method comprising:

providing an apparatus having a wellhead interface module located on a wellhead, the wellhead interface module comprising a body defining a chamber which accommodates a volume of wellbore fluid in fluid communication with the wellbore; and a system control module;

removing a length of tubing or casing from the wellbore;

enabling wellbore fluid to flow from the chamber into the wellbore;

measuring, using a level sensor of the wellhead interface module, the level of wellbore fluid in the chamber and outputting a measurement signal to the system control module; and providing wellbore fluid from a wellbore fluid source to the chamber in response to the measurement signal.

The method may comprise removing a second length of tubing or casing from the wellbore; measuring the level of wellbore fluid in the chamber and outputting a measurement signal to the system control module; and providing additional wellbore fluid from a wellbore fluid source to the chamber in response to the measurement signal.

The method may comprise repeating the steps of removing the tubing or casing and providing wellbore fluid from a wellbore fluid source to the chamber in response to the measurement signal.

The method may comprise cutting a length of tubing or casing, which step may be performed during refill of the chamber.

The method may comprise analysing the measurement signal to identify a condition of the wellbore, which may be classified as one or more of a steady state; a fluid influx state; a fluid loss state; a tubing run-in state; or a tubing pull-out state.

Embodiments of the sixth aspect of the invention may include one or more features of the first to fifth aspects of the invention or their embodiments, or vice versa.

According to a seventh aspect of the invention, there is provided a method of performing a plug and abandonment operation, the method comprising:

providing an apparatus having a wellhead interface module located on a wellhead, the wellhead interface module comprising a body defining a chamber which accommodates a volume of wellbore fluid in fluid communication with the wellbore; and a system control module;

removing a length of tubing or casing from the wellbore;

enabling wellbore fluid to flow from the chamber into the wellbore;

measuring, using a level sensor of the wellhead interface module, the level of wellbore fluid in the chamber and outputting a measurement signal to the system control module; and determining a condition of the wellbore independence on the measurement signal selected from a fluid loss condition, a fluid influx condition, or a steady state condition of the wellbore.

The method may comprise removing wellbore fluid to the chamber in a fluid influx condition of the wellbore. The method may comprise providing wellbore fluid to the chamber in a fluid loss condition of the wellbore.

Embodiments of the seventh aspect of the invention may include one or more features of the first to sixth aspects of the invention or their embodiments, or vice versa.

According to an eighth aspect of the invention, there is provided a method of controlling the volume of a fluid in a subsea wellbore system, the method comprising:

providing an apparatus having a wellhead interface module located on a wellhead, the wellhead interface module comprising a body defining a chamber which accommodates a volume of wellbore fluid in fluid communication with the wellbore; and a system control module;

on a change in wellbore conditions, causing flow of wellbore fluid between the chamber and the wellbore;

measuring, using a level sensor of the wellhead interface module, the level of wellbore fluid in the chamber and outputting a measurement signal to the system control module;

characterising, using the system control module, the change in wellbore conditions in dependence on the measurement signal from the level sensor.

Embodiments of the eighth aspect of the invention may include one or more features of the first to seventh aspects of the invention or their embodiments, or vice versa.

According to a ninth aspect of the invention, there is provided an apparatus for monitoring or controlling the volume of a fluid in a subsea wellbore system during a plug and abandonment operation, the apparatus comprising:

a wellhead interface module configured to be disposed on a wellhead, the wellhead interface module comprising a body defining a chamber which accommodates a volume of wellbore fluid in fluid communication with the wellbore;

and a system control module;

wherein the wellhead interface module comprises a sensor for measuring a volume of wellbore fluid in the chamber and outputting a measurement signal to the system control module;

wherein in use, a change in wellbore conditions causes wellbore fluid to flow between the chamber and the wellbore;

and wherein the system control module is configured to characterise the change in wellbore conditions in dependence on the measurement signal from the level sensor.

Embodiments of the ninth aspect of the invention may include one or more features of the first to eighth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
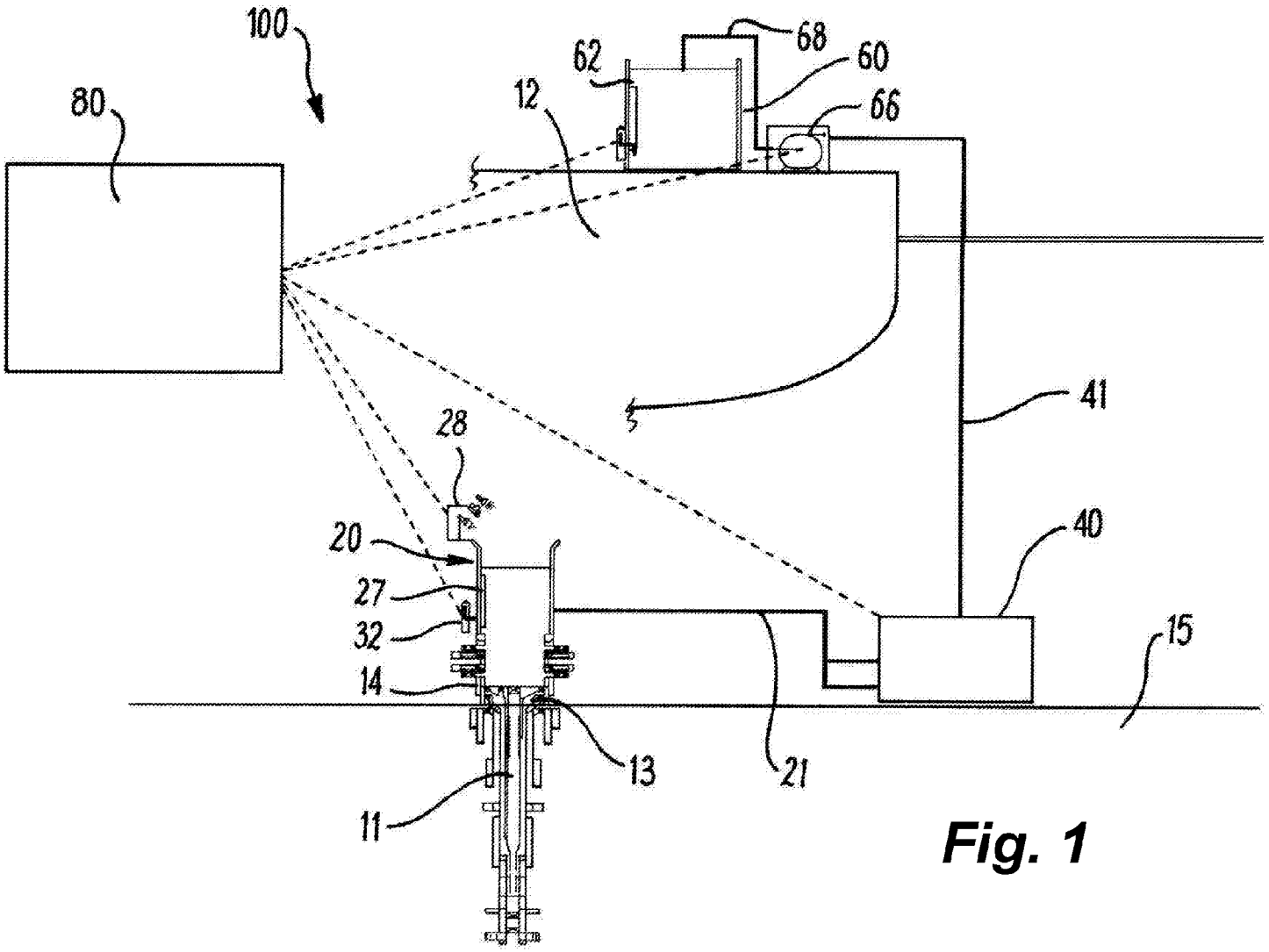
FIG. 1 is a schematic representation of a volume control system according to a first embodiment of the invention, consisting of a volume control apparatus and a vessel.
Figure 2:
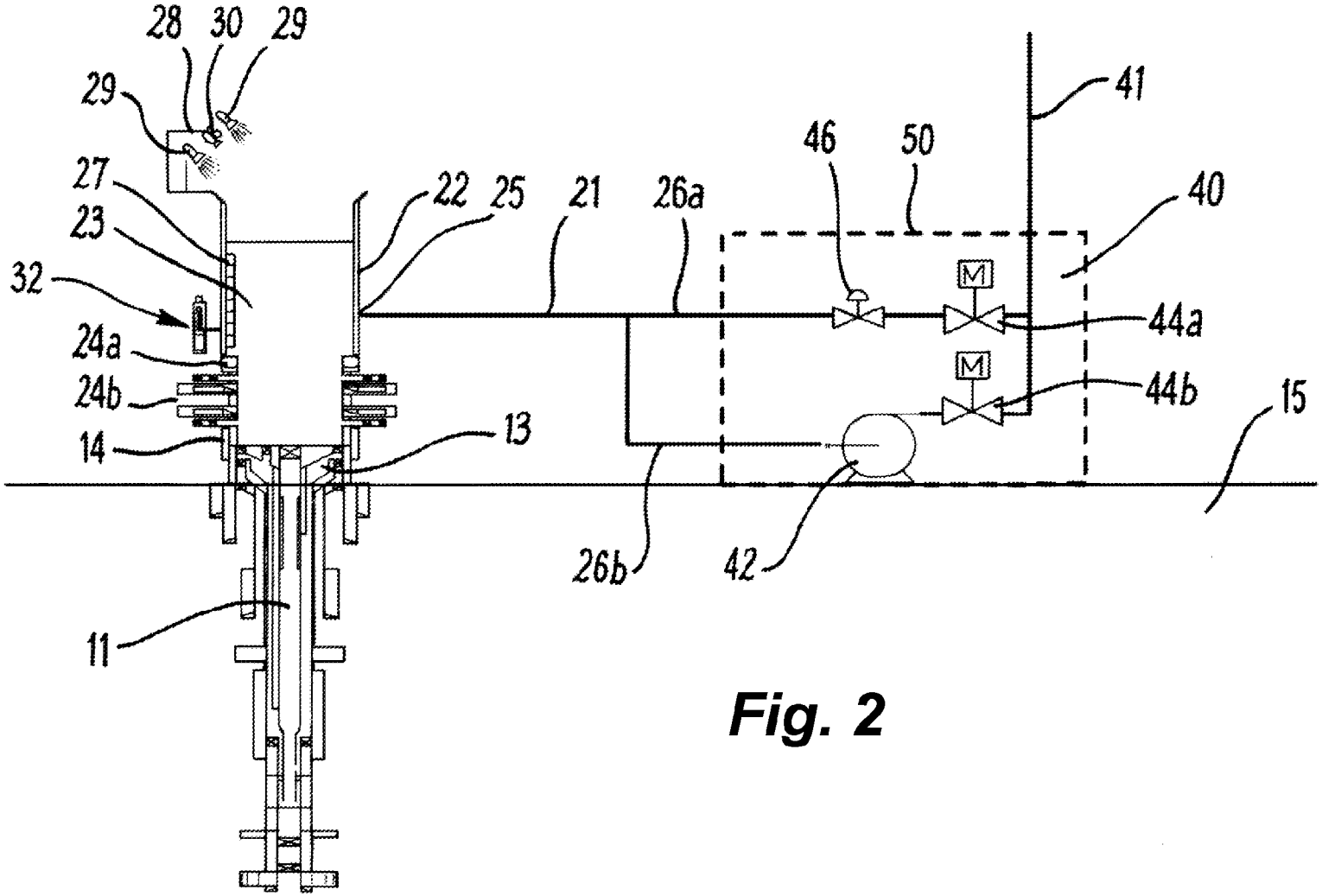
FIG. 2 is a schematic representation of a detail of subsea components of the volume control apparatus shown in FIG. 1.

Referring firstly to FIGS. 1 and 2, there is shown schematically a volume control system according to a first embodiment of the invention, generally depicted at 10, applied to a plug and abandonment operation in a subsea wellbore 11. The system 100 comprises a subsea wellhead interface module 20, a subsea flow control package 40, and a surface control package 60 on a vessel 12. The subsea wellhead interface module 20 is coupled to the subsea wellhead 13 of the wellbore 11 via a connector 14. The subsea flow control package 40 is located subsea, and in this example is a skid package resting on the seabed 15. The subsea wellhead interface module 20 and subsea flow control package 40 are connected by a seabed umbilical system 21 comprising electrical, hydraulic, and fluid lines. An upper umbilical 41 contains electrical, hydraulic, and fluid lines running between the subsea flow control package 40 and the surface control package 60 on the vessel. Also shown in FIG. 1 is a schematic representation of a system control module 80, which provides control and communication between the various components of the system, and which receives and processes, transmits and/or displays measurement data to an operator of the system. In this embodiment, the system control module 80 is implemented in software running on a computer on the vessel, which receives input data acquired from the system and processes the data for recording, display, and/or onward transmission.

The wellhead interface module 20 comprises a body 22 which defines a chamber in the form of a longitudinal throughbore 23, an upper end of which is open to the subsea environment. A second, lower end of the module 20 is in fluid communication with the wellbore 11, and is able to receive flow from the production bore or the annulus via wellhead valves. The wellhead interface module 20 is also provided with an annular BOP 24*a* and a shear-and-seal device 24*b*. The wellhead interface module 20 also comprises a pressure sensor 27 which functions to detect and measure the level of drilling fluid in the body 22 and provide a signal to the control module 80. A subsea camera system 28 comprising an illumination source 29 and a camera 30 is mounted to the module 20 to enable visual monitoring of the levels of fluid in the body 22, providing back-up to the pressure sensor 27. The camera system 28 also enables visual detection of gas bubbles in the wellbore fluid in the event of gas in flux.

Located between the first and second ends of the body is an outlet 25 which connects the throughbore 23 with a conduit which forms part of the seabed umbilical 21 and is connected to the subsea flow control package 40. The package 40 is mounted in a skid 50 which rests on the seabed 15. The package 40 comprises a flow control valve 46 communicating with a conduit portion 26*a* of the umbilical 21, and a variable speed subsea pump 42 coupled to a conduit portion 26*b* of the umbilical 21. The umbilical enables two-way communication between the various components of the wellhead interface module 20 and the system control module 80 and flow control package 40. A pair of subsea shut-off valves 44*a* and 44*b* enable selective isolation of the conduit portions 26*a*, 26*b* from a hose portion of the umbilical 41, which joins the subsea flow control package 40 to the surface control package 60. The subsea flow control package 40 also comprises pressure, depth and temperature sensors (not shown) and is in data communication with the control module 80 via the umbilical 21.

Conduit portions 26*a* and 26*b* define parallel flow paths, and the conduit portion 26*a* therefore provides a bypass flow path to the conduit portion 26*b* which comprises the pump 42.

The surface control package 60 is mounted on the vessel 12, which is preferably a lightweight intervention vessel (LWIV). As will be apparent from the present specification, the invention facilitates the provision of full volume control for the wellbore in a manner that is suitable for deployment from a LWIV, without relying on a drilling rig deployment process. This makes the systems of embodiments of the invention more cost-effective and time-efficient compared with traditional rig-deployed methods, and renders embodiments of the invention suitable for a wide range of applications. In particular this embodiment of the invention is suitable for plug and abandonment of category 2 and 3 wells from lightweight intervention vessels or other support vessels as will be described below.

The surface control package 60 comprises a drilling fluid tank 62, a feed pump 66, and a power supply for surface package and the subsea components 20 and 40. A launch and recovery system (not shown) is also provided for deployment and recovery of the subsea package 40 and optionally the wellhead interface module 20. The drilling fluid tank 62 is joined to the feed pump 66 via conduit 68, and also comprises pressure sensors which detect and measure the level of drilling fluid in the tank 62 and provide a signal to the control module 80. An external transceiver 64 enables two-way communication between the package 60 and the system control module 80.

Figure 3:
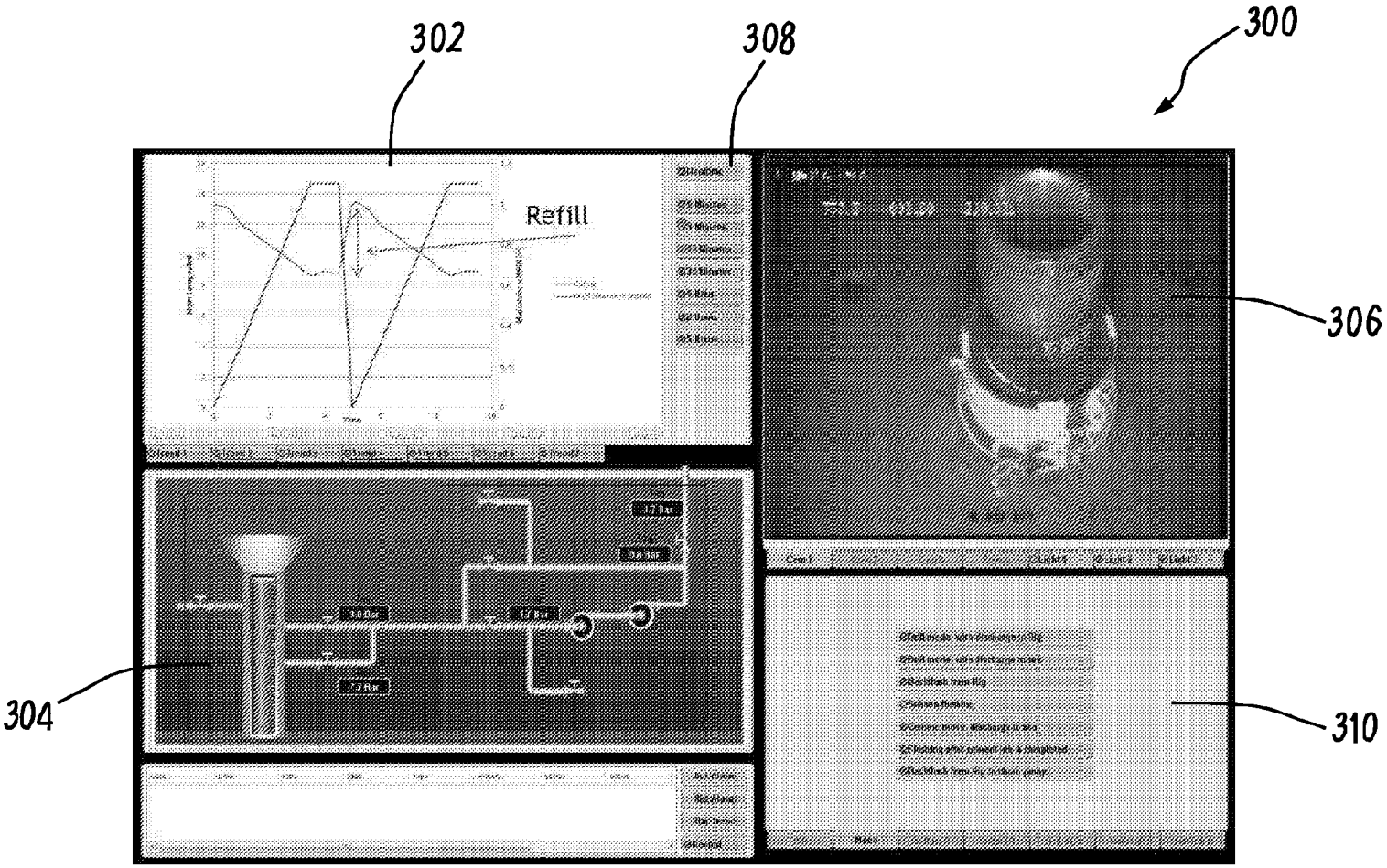
FIG. 3 is a representative screenshot of a control module used in conjunction with the volume control system of FIG. 1.

Referring now to FIG. 3, there is shown a representative screenshot for the subsea control module 80 in a plug and abandonment application. As described above, the system control module 80 is implemented in software running on a computer on the vessel, which receives input data acquired from the system and enables transmission of control signals for operation of the surface and subsea components. Data pertaining to the operation is displayed at 302, which in this case is a graph which includes plots of changing fluid levels over time. Screen area 304 displays a representation of the conduits and hoses of the system including pressure data from a number of pressure sensors distributed around the system. Screen area 306 displays an image captured from the cameras 29, enabling an operator to view the activity at the body 22. A number of graphical user interface icons are provided at 308 and 310 to provide an operator with the ability to control the system and/or elements of the display. The system control module 80 is therefore able to display data from the system, which may be in real-time, and issue control instructions to begin, cease or modify operations from a single interface.

Use of the system of this embodiment will now be described in the context of a plug and abandonment operation.

The wellhead interface module 20 is deployed from the LWIV 12 to the seabed, assisted by remotely operated vehicles (ROVS) or divers as is known in the art. The module 20 is connected to the wellhead 13 via a connector 14. The subsea flow control package skid 50 is deployed to the seabed from a launch and recovery system on the vessel, again with the assistance of ROVs or divers. The skid 50 is deployed with the hose 41 connected to the package 40, to avoid making up a wet mate connection subsea, although it will be appreciated that subsea connection is also possible. The subsea shut-off valves 44*a*, 44*b* are closed, and the subsea package 40 is preferably deployed along with the seabed umbilical 21 and conduit portions 26*a*, 26*b* already connected to the subsea package, only requiring make up of the seabed umbilical 21 with the outlet 25 of the wellhead interface module 20.

Figure 4:
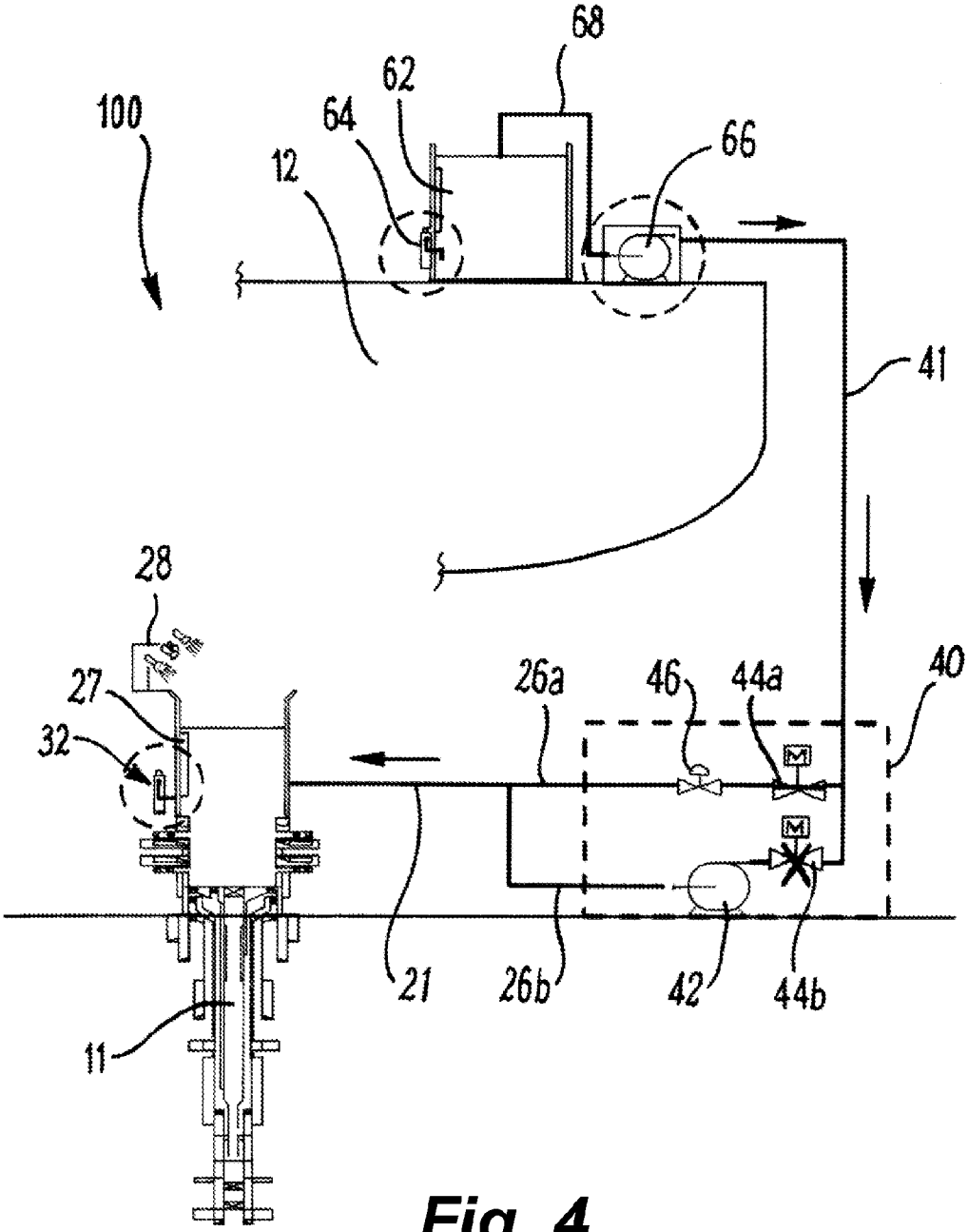
FIG. 4 is a schematic representation of a detail of subsea components of the volume control apparatus shown in FIG. 1 during a filling operation.

With reference to FIG. 4, and with the three main components of the system connected, the subsea flow control valve 46 and subsea shut-off valve 44*b* are closed, and the subsea shut-off valve 44*a* is opened by a signal from the system control module 80. The feed pump 66 is activated to create a differential pressure sufficient to initiate flow of drilling fluid from the tank 62 to the subsea flow control module, and the flow control valve 46 is gradually opened to allow controlled flow of drilling fluid to the chamber of the wellhead interface module 20. The flow control valve 46 enables flow due to the hydrostatic head of fluid to be controlled, and prevents unwanted filling of the wellhead interface module 20. As the drilling fluid level increases, the sensors 27 and camera system 30 monitor the level in the throughbore 23. When the level has reached the desired level, the valve 46 is closed and the feed pump 62 is switched off.

During a plug and abandonment operation, coiled tubing intervention tools are deployed from a vessel (which may be LWIV 12 or may be another support vessel) to the wellhead to perform the plugging and/or cutting operations. When the production tubing and/or casing has been is ready to be pulled from the hole, the system is used to monitor and control the volume of drilling fluid in the wellbore system as follows.

Figure 5:
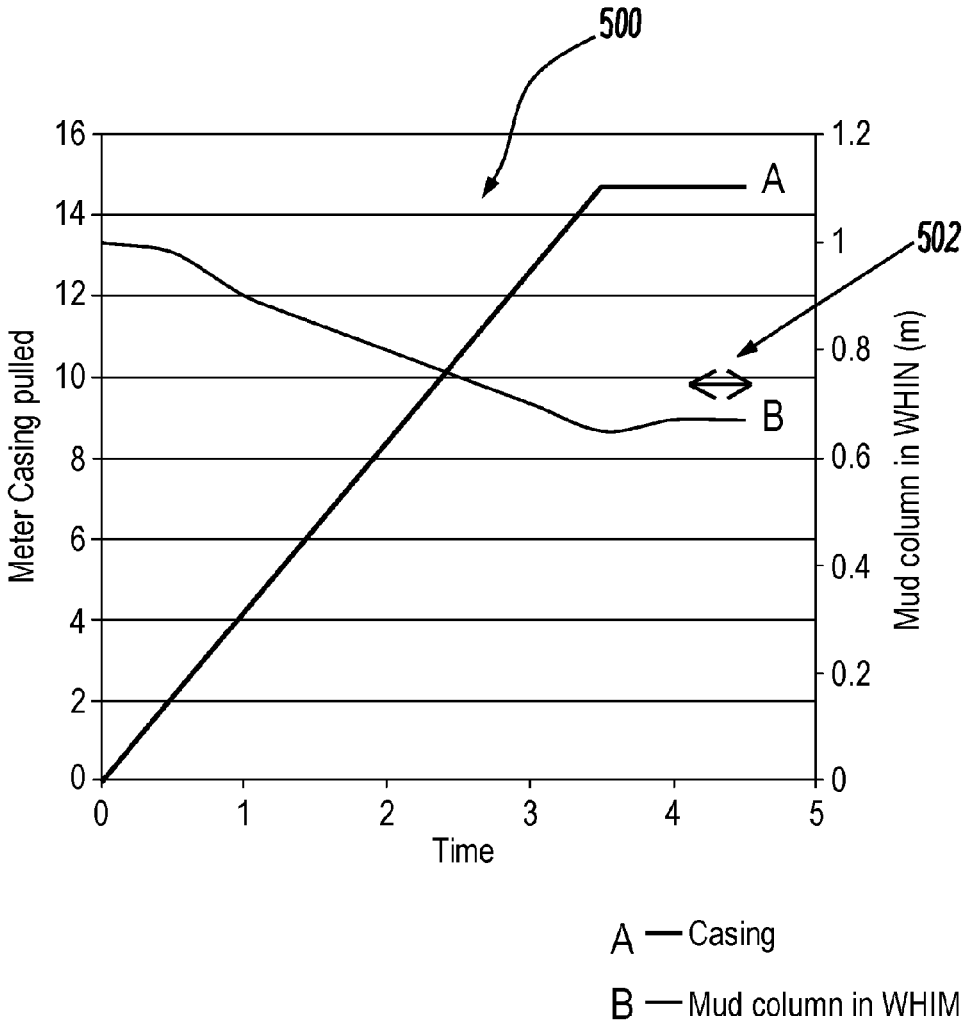
FIG. 5 is a graph showing plots of the length of casing pulled from a wellbore and a measured drilling fluid column height over time during a tubing pulling operation.

FIG. 5 is a graph 500 which plots a tubing retrieval length and a corresponding measured change in the fluid level in the throughbore 23 of the wellhead interface module 20, both against a time axis. The fluid level measurement corresponds to a volume of wellbore fluid in the combined wellbore system consisting of the wellhead interface module 20 and wellbore itself, and monitoring the fluid level in the chamber of the wellhead interface module 20 enables data relating to a volume change in the wellbore system to be derived.

During a preliminary phase, referred to as a flow check operation, fluid level measurements are collected and analysed with the tubing or casing stationary in the wellbore. Plot B shows at arrow 501 the response during steady state (i.e. flow check) conditions, i.e. where the pumps are not operational and drilling fluid is not circulated, and there is no movement of the tubing or casing. The volume of fluid is verified as being constant during the flow check phase of the operation.

When the tubing or casing is ready to be pulled from hole, lifting cable or a drill string is deployed from the surface vessel 12 and engaged with the top of the tubing or casing.

Plot B of FIG. 5 shows a drop in fluid levels in the throughbore 23 as tubing is pulled out of hole, resulting from additional fluid from the chamber defined by the throughbore 23 entering the wellbore into the volume previously occupied by the tubing material. The removal of the tubing from the wellbore results in a reduction in fluid volume of tubing within the wellbore itself, as the upper end of the tubing is pulled out of the well into the subsea environment. The specification of the well tubing being known, it is possible to compute the expected volume change in the wellbore as the tubing is removed.

As the tubing is removed, wellbore fluid passes from the chamber and into the wellbore itself, displacing the volume previously occupied by the material of the tubing. The reduction in fluid volume the chamber is derived from the measurement of fluid levels, and compared with the expected volume change due to the removal of well tubing. This comparison of a measured or derived volume change with the expected volume change enables conditions in the wellbore to be characterised, for example as a steady state; a fluid influx state; or a fluid loss state, as described below.

FIG. 5 also shows that when the removal of the tubing ceases (indicated at 503 on the graph), the fluid level in the chamber remains static (shown at 502). This is verified as part of a flow check operation prior to subsequent operational steps.

Figure 6:
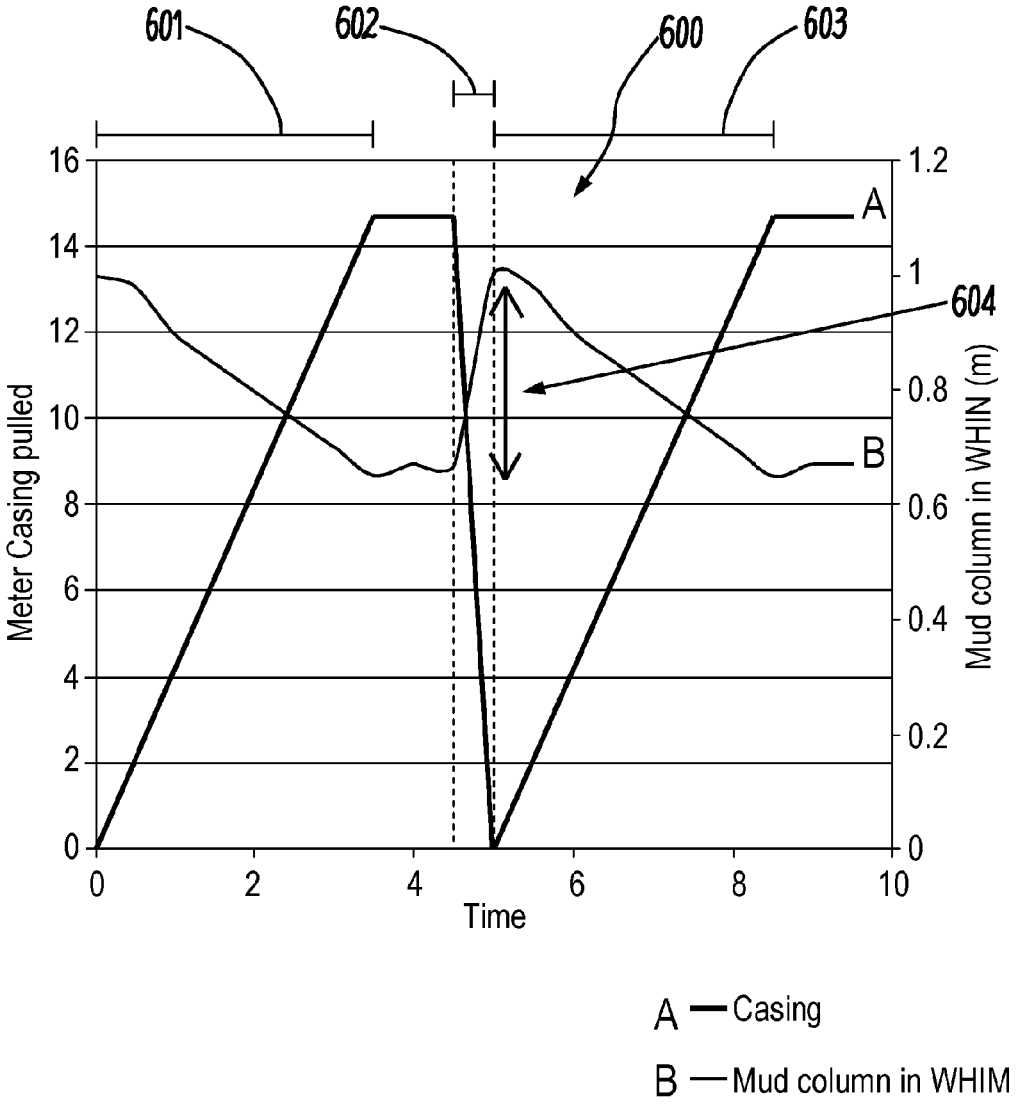
FIG. 6 is a graph showing plots of the length of casing pulled from a wellbore and a measured drilling fluid column height over time during a pulling and refilling operation.

FIG. 6 is a graph 600 which plots a tubing retrieval length and a corresponding measured change in the fluid levels in the throughbore 23 of the wellhead interface module 20 during tubing pulling and re-filling. The data shows the fluid level response as a length of tubing, in this case about 15 m, is pulled under conditions when the pumps are not operational and drilling fluid is not circulated over the time period 601. Plot B shows a drop in fluid levels in the throughbore 23 as tubing is pulled out of hole in period 601, as fluid from the chamber displaces the volume of tubing material removed from the well (the response in period 601 corresponds to plot B of FIG. 5). As described above, a comparison of a volume change derived from the change in fluid level with an expected volume change enables conditions in the wellbore to be characterised.

After approximately 15 m of tubing or casing has been pulled, the level of fluid in the chamber has dropped. During an initial phase of pulling the tubing to the surface of the sea, before the upper part of the tubing has reached surface, the pulling operation is interrupted. This enables the wellbore fluid in the combined wellbore system to be replenished under steady conditions.

FIG. 4 depicts the system being operated in a re-fill mode. The subsea flow control valve 46 and subsea shut-off valve **44*b* are closed, and the subsea shut-off valve 44*a* is opened by a signal from the system control module 80. The feed pump 66 is activated and the flow control valve 46 is gradually opened to allow controlled flow of drilling fluid to the chamber of the wellhead interface module 20. As the drilling fluid level increases, the sensors 27 and camera system 30 monitor the level in the throughbore 23. When the drilling fluid has reached the desired level, the valve 46 is closed and the feed pump 62** is switched off.

The re-filling of the chamber takes place during the time period 602, in which plot B shows (at 604) an increase in the fluid level in the chamber. Pulling of the tubing or casing recommences in the period 603, in which plot B shows a corresponding reduction in drilling fluid level. The process is repeated as successive lengths of tubing or casing are removed from the wellbore, with the re-filling of the chamber of the subsea module taking place between successive pulling phases.

It may be preferable for the replenishment or re-filling of the chamber to take place during a period in which the tubing is not being pulled, as this may facilitate accurate monitoring of the fluid volume and control of the fluid replenishment step.

Where a drill string is being used to pull the tubing or casing from the wellbore (as may be the case in some embodiments of the invention), the uppermost joints of the drill string may be disassembled at surface at the same time as fluid replenishment. The fluid replenishment periods may be determined by disassembly of drill string sections, or by depletion of the fluid volume in the chamber, depending on the configuration of the system. Either way, it is convenient for the operations to be performed simultaneously for the efficiency of the plug and abandonment operation.

Use of a lifting cable, as will be the case in certain embodiments of the invention, enables continuous lifting. However, it is possible even in this configuration for the pulling operation to be performed in discrete steps to allow controlled re-filling under steady state conditions.

When the tubing or casing reaches the surface, it becomes necessary to cut the upper portions of the tubing or casing at regular intervals. In certain embodiments of the invention, the re-filling of the wellbore system takes place during cutting of the tubing or casing, to improve the efficiency of the plug and abandonment operation.

It will be appreciated that in an alternative embodiment, the chamber of the module 20 may be re-filled during pulling of the tubing or casing out of hole, with the level of drilling fluid constantly monitored by the system control module 80. During operation, the system control module 80 uses data from the sensors 27 and 64, and controls the operation of the valves and pumps in the surface and subsea flow control modules to manage the fluid volume in the wellbore at a suitable value.

The above-described embodiment of the invention provides a volume buffer which accommodates the change in fluid volume in the wellbore system during each pull and cut stage as material is removed from the well. The system provides full volume monitoring and control without reliance on a marine riser: the drilling fluid which is displacing the pulled tubing is provided directly from a subsea chamber forming a part of the wellhead interface module. The system provides sufficient drilling fluid in the tank 62 to provide fluid displacement for the volume of tubing material being removed. However, in alternative embodiments, additional auxiliary drilling fluid volumes may be provided from additional tanks or pits.

In the embodiments described with reference to FIGS. 1 to 9, the wellbore fluid is replenished via a conduit from the flow control package. It will be appreciated that other mechanisms for delivering wellbore fluid to the wellbore system may be used in alternative embodiments. This includes (but is not limited to) a dedicated flow conduit from the surface or a remote subsea location to the chamber. A further alternative is to provide wellbore fluid from the surface via the drill string, through the casing or tubing being pulled, and out of the lower end of the casing or tubing to replenish the fluid volume from the wellbore (from which fluid is displaced upwards into the chamber).

Figure 7:
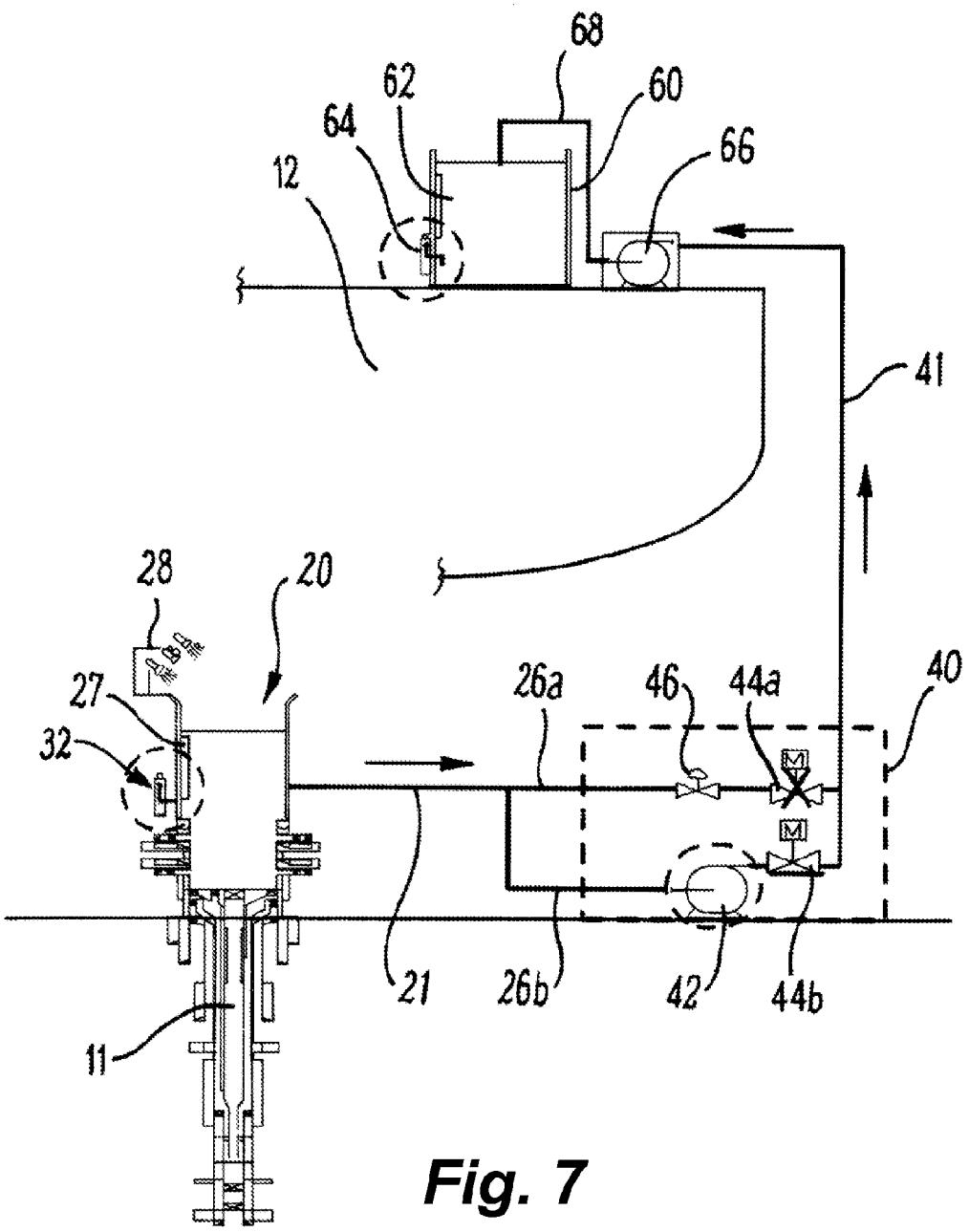
FIG. 7 is a schematic representation of a detail of subsea components of the volume control apparatus shown in FIG. 1 during a period of influx.
Figure 8:
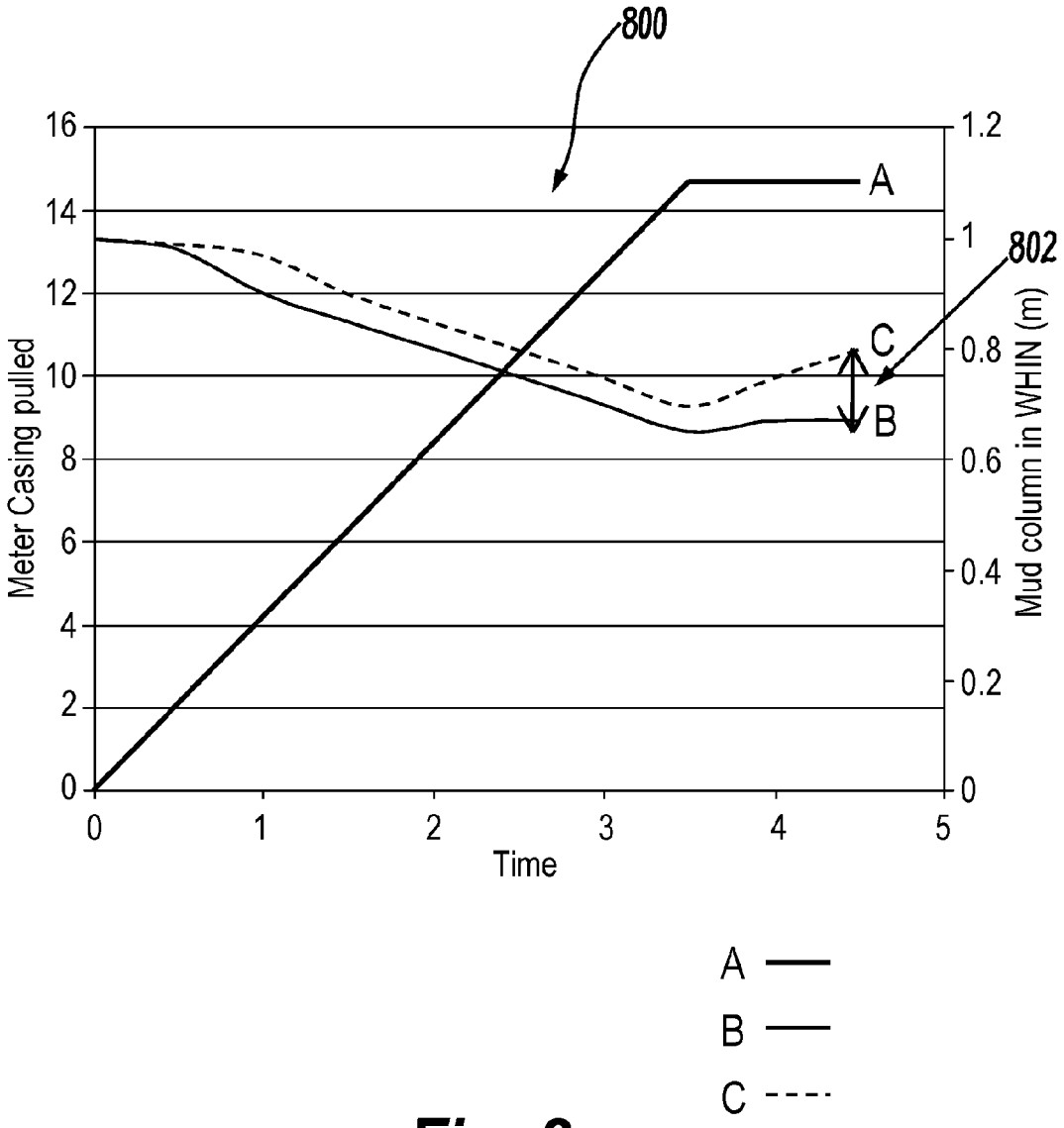
FIG. 8 is a graph showing plots of the length of casing pulled from a wellbore and a measured drilling fluid column height over time during a period of fluid influx.

FIG. 7 schematically shows the system 100 used during an operational phase in which fluid influx occurs from the wellbore. FIG. 8 is a graph 800 which plots a tubing retrieval length and a corresponding measured change in the fluid levels in the throughbore 23 of the wellhead interface module 20 during pulling of tubing from the wellbore. As a length of tubing or casing is pulled, as shown at plot A, the sensors of the module 20 detect a drop in drilling fluid level. This measured data is shown at plot C. A comparison with the expected volume change (shown at plot B), reveals a discrepancy between the measured change in volume and that expected for the length of tubing removed, indicated at 802. The discrepancy shows that there is additional fluid in the chamber of the module 20, which is indicative of fluid influx into the wellbore. A problem with the seals provided by the plugs can be inferred from the presence of fluid influx, which allows the operator (via the control module 80) to activate the pump 42 to pump excess fluid to the vessel 12 via the return line. In this mode of operation the subsea shut-off valve 44*a* is closed, and the valve 44*b* is open. Drilling fluid is pumped from the chamber of the module 20 via conduit portion 26*b* to the skid 50, and upwards to the vessel 12. A bypass conduit (not shown) may be provided for the feed pump 66.

Alternatively, the influx may result in the well being identified as being unsuccessfully plugged, and can be shut-in temporarily, pending attendance by a drilling rig closed-loop plug and abandonment system (this may be necessary where the fluid influx is identified as severe and beyond the handling capabilities of the system 100).

In a further alternative embodiment, the excess fluid may be contained at the seabed in an auxiliary tank or discharged to the subsea environment. In such embodiments, the subsea pump may be omitted from the subsea flow control package 40. However, inclusion of a subsea pump is preferred as it avoids undesirable discharge of drilling fluids into the sea.

The system 100 may also be used in the configuration shown in FIG. 7 to flush the return line with seawater at the end of the operation. With the wellbore shut-in, drilling fluid present in the chamber may be pumped through the conduit portion 26*b* and upwards through the return line 41. When the chamber is depleted of drilling fluid, seawater from the surrounding seawater will enter the upper opening of the chamber and will be pumped through the seabed umbilical 21, through the subsea flow control package 40 via the pump 42 and the shut-off valve 44*b*, and up through the return line. Valve arrangements (not shown) may also allow complete flushing of the conduit portion 26*a*, flow control valve 46 and shut-off valve 44*b*.

Figure 9:
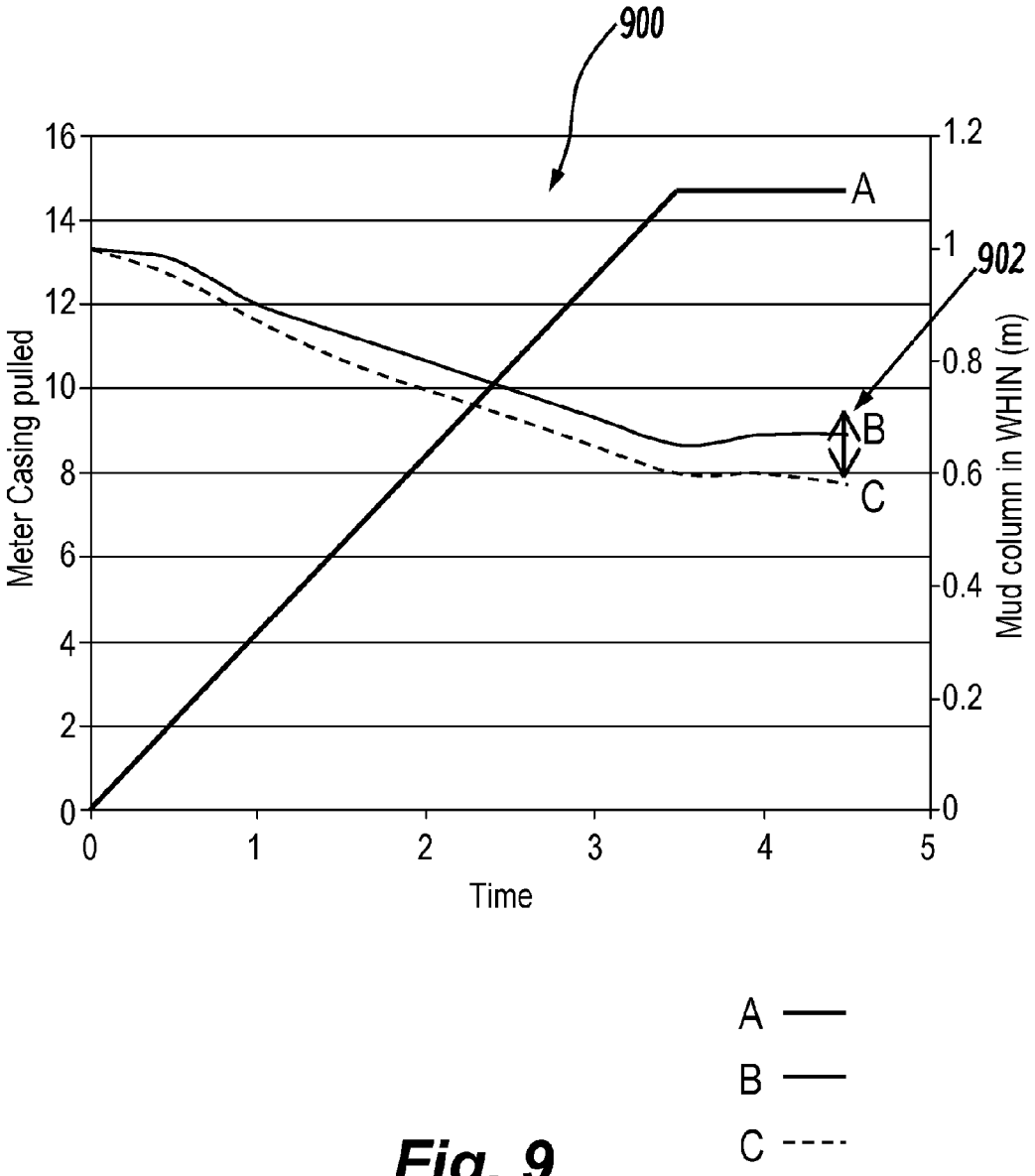
FIG. 9 is a graph showing plots of the length of casing pulled from a wellbore and the drilling fluid column height over time during a period of fluid loss.

It will be apparent that the system 100 may also be used to identify a drilling fluid loss. FIG. 9 is a graph 900 which plots a tubing retrieval length and a corresponding measured change in the fluid levels in the throughbore 23 of the wellhead interface module 20 during pulling of tubing from the wellbore. As a length of tubing or casing is pulled, shown at plot A, the sensors of the module 20 detect a drop in drilling fluid level, shown at plot C. A comparison with the expected volume change (shown at plot B), reveals a discrepancy between the measured change in volume and that expected for the length of tubing removed (indicated at 902), which shows that there is less fluid in the chamber of the module 20. This is indicative of fluid losses to the formation. To replace fluid losses, the operator (via the control module 80) may activate the feed pump 66 and open the flow control valve 46 to allow controlled flow of drilling fluid to the chamber of the wellhead interface module 20. Alternatively an additional wellbore intervention may be performed in order to remediate fluid losses.

The invention provides a method of and apparatus for performing a plug and abandonment operation on a subsea hydrocarbon well. The method comprises providing an apparatus having a wellhead interface module located on a wellhead, which accommodates a volume of wellbore fluid in fluid communication with the wellbore. A system control module receives a measurement signal from a sensor for monitoring at least one parameter of the wellbore fluid in the chamber. The system control module is configured to derive volume data relating to a change in volume of wellbore fluid in the chamber and compares the derived volume data with a volume change expected due to the removal of tubing or casing from the wellbore. This enables a change in wellbore conditions to be characterised, for example a fluid influx or a fluid loss, from the volume data. The method comprises providing additional wellbore fluid to the chamber to replace fluid which enters the wellbore to occupy the volume vacated by the removed tubing, and/or removing or adding fluid in fluid influx/loss situations respectively.

The invention addresses one or more of the problems associated with conventional plugging and abandonment techniques when used from vessels. In particular, the invention provides a method and apparatus for controlled re-filling of a subsea hydrocarbon well from a dedicated well fluid conduit during a plugging and abandonment operation. The operation may be performed from a LWIV and without relying on a drilling rig and/or marine riser system.

Various modifications to the above-described embodiments may be made within the scope of the invention, and the invention extends to combinations of features other than those expressly claimed herein.

The invention claimed is:

1. A riser-less method of performing a plug and abandonment operation on a subsea hydrocarbon well from a vessel, the method comprising:

providing an apparatus, the apparatus comprising:

a wellhead interface module located on a wellhead, the wellhead interface module comprising a body defining a chamber which accommodates a volume of wellbore fluid in fluid communication with the wellbore, an upper end of the chamber being open to the subsea environment;

a subsea flow control package;

a fluid conduit extending between the subsea flow control package and surface;

and a system control module;

wherein the subsea flow control package defines a first flow path between the wellhead interface module and the fluid conduit via a pump and defines a second flow path between the wellhead interface module and the fluid conduit via a flow control valve;

removing a length of tubing or casing from the wellbore;

controlling, using the subsea flow control package, the flow of a wellbore fluid from the fluid conduit to re-fill the chamber of the wellhead interface module;

enabling wellbore fluid to flow from the chamber into the wellbore;

measuring, using a level sensor of the wellhead interface module, a level of the wellbore fluid in the chamber and outputting a measurement signal to the system control module in dependence on the level of wellbore fluid;

deriving volume data relating to a change in volume of wellbore fluid in the chamber, said change in volume being derived from the change in the level of the wellbore fluid in the chamber; and comparing the derived volume data with a volume change expected due to the removal of tubing or casing from the wellbore.

2. The method according to claim 1 comprising analysing the measurement signal to identify a condition of the wellbore, and characterising the condition as one or more of the conditions in the group consisting of: a steady state; a fluid influx state; a fluid loss state; a tubing run-in state; or a tubing pull-out state.

3. The method according to claim 1 comprising:

removing a second length of tubing or casing from the wellbore;

monitoring the level of the wellbore fluid in the chamber; and outputting a measurement signal to the system control module in dependence on the level of wellbore fluid.

4. The method according to claim 1 comprising providing wellbore fluid from a wellbore fluid source to the apparatus in response to the derived volume data.

5. The method according to claim 4 comprising repeating the steps of removing a tubing or casing and providing wellbore fluid from the wellbore fluid source to the apparatus in response to the measurement signal.

6. The method according to claim 4 comprising providing additional wellbore fluid from the wellbore fluid source to the chamber of the wellhead interface module in response to the derived volume data, wherein the wellbore fluid source is at the surface.

7. The method according to claim 4 comprising providing wellbore fluid from the wellbore fluid source to the apparatus while the tubing or casing is stationary.

8. The method according to claim 4 comprising providing wellbore fluid from the wellbore fluid source to the apparatus while the tubing or casing is being removed from the wellbore.

9. The method according to claim 1 comprising cutting a length of tubing or casing during the provision of wellbore fluid from a wellbore fluid source to the wellbore or apparatus.

10. The method according to claim 4 comprising pumping wellbore fluid from the wellbore fluid source.

11. The method according to claim 1 comprising controlling the flow of wellbore fluid to the chamber using the flow control valve.

12. The method according to claim 11 comprising choking the flow of wellbore fluid to the chamber using the flow control valve.

13. The method according to claim 1 comprising pumping wellbore fluid from the chamber to the surface.

14. The method according to claim 1 comprising providing a vessel without a marine riser system.

15. An apparatus for monitoring and/or controlling a volume of a fluid in a subsea wellbore system during a riser-less plug and abandonment operation, the apparatus comprising:

a wellhead interface module configured to be disposed on a wellhead, the wellhead interface module comprising a body defining a chamber which accommodates a volume of wellbore fluid in fluid communication with the wellbore, an upper end of the chamber being open to the subsea environment;

a subsea flow control package;

a fluid conduit extending between the subsea flow control package and surface;

and a system control module;

wherein the subsea flow control package defines a first flow path between the wellhead interface module and the fluid conduit via a pump, and defines a second flow path between the wellhead interface module and the fluid conduit via a flow control valve;

wherein the wellhead interface module comprises a sensor that measures the level of fluid in the chamber and outputs a measurement signal to the system control module;

wherein the system control module is configured to derive volume data relating to a change in volume of wellbore fluid in the chamber and compare the derived volume data with a volume change expected due to the removal of tubing or casing from the wellbore, said change in volume being derived from a change in the level of the wellbore fluid in the chamber;

and wherein the subsea flow control package is configured to control the flow of fluid from the fluid conduit to the wellhead interface module.

16. The apparatus according to claim 15 wherein the system control module is configured to characterise a change in wellbore conditions according to the group comprising: a steady state; a fluid influx state; a fluid loss state; a tubing run-in state; or a tubing pull-out state.

17. The apparatus according to claim 15 further comprising a surface flow control package, wherein the fluid conduit connects the subsea flow control package with the surface flow control package.

18. The apparatus according to claim 15 further comprising a wellbore fluid source connected to the wellhead interface module via the fluid conduit.

19. The apparatus according to claim 15 wherein the system control module is configured to direct the flow from the wellhead interface module to the fluid conduit via the first flow path.

20. The apparatus according to claim 15 wherein the system control module is configured to direct the flow from the fluid conduit to the wellhead interface module via the second flow path.

21. The apparatus according to claim 15 wherein the pump is a variable speed pump.

22. The apparatus according to claim 15 wherein the flow control valve is configured to choke the flow from the fluid conduit to the wellhead interface module.

23. A system comprising the apparatus according to claim 15, a vessel, and a wellbore on which the wellhead interface module is disposed, wherein the vessel is without a marine riser system.

24. The method according to claim 23 comprising removing a length of tubing or casing from the wellbore using a lifting cable or drill string deployed from the vessel.

25. The method according to claim 23 comprising deploying the apparatus from the vessel.

* * * * *